US005947581A

United States Patent [19]

Schrimmer et al.

[11] Patent Number: 5,947,581

[45] Date of Patent: Sep. 7, 1999

[54] ILLUMINATED BALLOON HAVING A SELF-CONTAINED LIGHT MEMBER

[75] Inventors: Michael L. Schrimmer, Wheeling; Ronald Eugene Gilley, Arlington Heights, both of Ill.

[73] Assignee: Chemical Light, Inc., Vernon Hills, Ill.

[21] Appl. No.: 08/874,309

[22] Filed: Jun. 13, 1997

[51] Int. Cl.[6] ..... F21V 33/00

[52] U.S. Cl. ..... 362/96; 362/189; 362/363; 362/806

[58] Field of Search ..... 362/96, 189, 186, 362/806, 363, 352

[56] References Cited

U.S. PATENT DOCUMENTS

| | | | |
|---|---|---|---|
| 2,383,390 | 8/1945 | Jacobs | 362/186 X |
| 2,936,366 | 5/1960 | Rainford | 362/363 |
| 3,592,157 | 7/1971 | Schwartz . | |
| 4,292,999 | 10/1981 | Szollmann . | |
| 4,542,445 | 9/1985 | Marletta | 362/96 |
| 4,736,281 | 4/1988 | Neumeier | 362/186 |
| 4,794,498 | 12/1988 | Neumeier | 362/186 |
| 4,997,403 | 3/1991 | Akman . | |
| 5,075,830 | 12/1991 | Perez | 362/352 |
| 5,083,250 | 1/1992 | Malcolm | 362/253 |
| 5,117,344 | 5/1992 | Perez | 362/352 |
| 5,119,281 | 6/1992 | Akman | 362/253 |
| 5,143,439 | 9/1992 | Lewis | 362/103 |
| 5,215,492 | 6/1993 | Kubiatowicz | 446/219 |
| 5,295,891 | 3/1994 | Schalk . | |
| 5,444,607 | 8/1995 | Dreyfuss | 362/352 |
| 5,609,411 | 3/1997 | Wang | 362/363 X |
| 5,857,760 | 1/1999 | Pelton | 362/806 X |

*Primary Examiner*—Laura K. Tso
*Attorney, Agent, or Firm*—Welsh & Katz, Ltd.

[57] ABSTRACT

An illuminated balloon includes a substantially gas-impermeable membrane capable of pressurized gas storage and a self-contained illuminating member fully positioned within the balloon. The membrane defines a gas storage region having an inner surface and an outer surface and a neck portion. The neck portion includes an opening therein for introducing a gas to inflate the balloon. The illuminating member is self-contained and includes an illuminating element and a power source electrically connected thereto. The illuminating member, including the power source, is completely within the gas storage region. The illuminating member can include a light emitting diode (LED) and circuitry to provide pulsating power to the LED.

13 Claims, 3 Drawing Sheets

ILLUMINATED BALLOON HAVING A SELF-CONTAINED LIGHT MEMBER

FIELD OF THE INVENTION

This invention relates to an illuminated balloon. More particularly, the invention relates to an illuminated balloon having a self-contained light member.

BACKGROUND OF THE INVENTION

Balloons have been, and continue to be a widespread and popular novelty item. They are often presented as gifts, used in displays and as decorations. Balloons are given away as promotional items and are sold, for example, at zoos, parks and the like.

People of all ages enjoy balloons and are entertained by novelty balloons, such as those that are filled with a buoyant gas, such as helium, to produce a "floating" effect of the balloon. Vendors can often be seen holding a handful of colorful helium filled balloons tied to ribbons, attracting large numbers of potential purchasers.

Like many novelty items, balloons have undergone substantial development, in part, in an effort to increase their attractiveness to buyers. Although latex was, and is still a commonly used balloon material, film-like polymeric materials such as Mylar® have become quite popular for use in manufacturing balloons. Such film-like materials have a number of advantages over common latex balloons.

First, these film-like materials can be produced in a variety of colors including metallic colors, and can also be produced in transparent form. As such, these balloons can be created having multi-colored bodies and ornate designs. Moreover, when transparent materials are used, the inside portion of the balloon can be used to provide yet another dimension to the creativeness of such balloon designs.

In addition, because these film-like materials do not yield or stretch as do the latex materials, the film-like balloons can be formed in a variety of shapes which maintain their general configuration when inflated.

Nevertheless, as popular as balloons have become, they are limited in that they can only be seen when lighted by an external source. Various devices are known for illuminating balloons. However, these devices suffer from a number of drawbacks.

First, these devices generally use an incandescent lighting device which tends to generate a considerable amount of heat. This can be detrimental to the balloon, and create a burn risk for a user. In addition, such incandescent lighting also requires a considerable amount of electrical power. Typically, when power for the lighting is provided by batteries, the batteries are contained in a separate battery compartment which is connected to the light by wires. Such wires have a tendency to tangle and be easily torn or severed, rendering the balloon lighting device inoperable.

Moreover, such battery powered lighting devices can require frequent battery replacement. As most consumers will recognize, after the lighting device exhausts one or two sets of batteries, and the novelty of the balloon diminishes, battery replacements will come less and less frequently, as will use of the balloon.

Accordingly, there continues to be a need for an illuminated balloon that is self contained, generates little heat, and provides extended time periods between required battery replacements. Such an illuminated balloon will further be fully self contained, and will not require a separate battery compartment connected to the balloon by wires that can become tangled.

SUMMARY OF THE INVENTION

An illuminated balloon includes a substantially gas-impermeable membrane capable of pressurized gas storage and light means positioned completely within the balloon. The membrane defines a gas storage region. The balloon has an inner surface and an outer surface and includes a neck portion having an opening therein for introducing a gas to inflate the balloon.

The light means is self-contained and includes an illuminating element, preferably a light emitting diode (LED) and a power source electrically connected to the illuminating element. The light means, including the power source, is completely contained within the gas storage region.

The present illuminated balloon provides a number of advantages over known illuminated balloons. One significant advantage is that the light means is completely contained within the balloon and thus, a separate battery "compartment" is not required. Because a separate battery compartment is not needed, there are no electrical wires or electrical connectors that extend between the light and the power source, that are external to the balloon, that could otherwise become tangled or tear.

Moreover, unlike known illuminated balloon devices, the present illuminated balloon uses a light means that is sufficiently light-weight that it does not adversely impact the ability of the balloon to "float" in air when it is filled with a buoyant gas, such as helium.

In one embodiment, the balloon membrane is formed of an expandable material such as latex rubber. In another embodiment, the membrane is formed of a film-like material. One such film-like material is Mylar®.

The balloon can include a mounting member for mounting the light means to the membrane. Preferably, the mounting member includes a peripheral edge having an adhesion region at which it is affixed to the membrane. The mounting member is affixed to the membrane with the light means positioned or sandwiched between the membrane and the mounting member.

In one embodiment, the mounting member defines an opening therein spaced from the peripheral edge. The opening in the mounting member is aligned with the illuminating element when said mounting member is positioned on the membrane. In this configuration, the illuminating element extends through the opening, inward of the pressure region. The mounting member can include a reflective surface to increase the extent to which light "bounces" off of the surfaces of the balloon.

Preferably, the light means includes an LED, at least one battery and circuitry for providing power to the LED. The circuitry can provide pulsating power to the LED to produce a flashing effect. The LED can be colored or tinted to produced colorful lighting effects.

The membrane, which can be formed in panels, can include one or more transparent panels and one or more reflective panels. The transparent and reflective panel configuration greatly enhances the visual effects of the balloon.

In another embodiment, a latex-type balloon is used. The light button can be freely placed in the balloon to move around as the balloon moves. Optionally, the light button can be affixed to a ribbon that is used as the balloon handle.

Other features and advantages of the present invention will be apparent from the following detailed description, the accompanying drawings, and the appended claims.

DETAILED DESCRIPTION OF THE PREFERRED EMBODIMENTS

Figure 1:
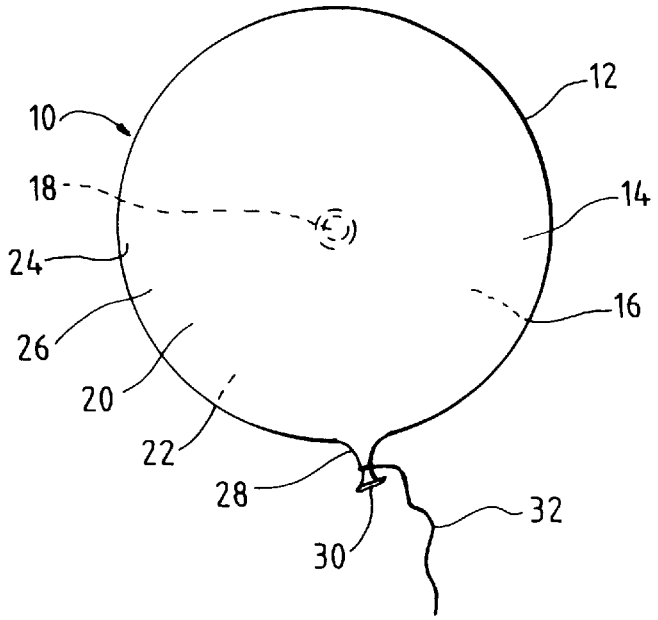
FIG. 1 is front view of an embodiment of an illuminated balloon, in accordance with the principles of the present invention, in which the balloon is formed from a film-like or film-type material having a light button positioned in an inside mount configuration.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated Referring now to the figures, and in particular to FIGS. 1–4, there is shown an embodiment of an illuminated balloon 10 in accordance with the principles of the present invention. The illuminated balloon 10 includes, generally, a membrane 12 defining a balloon body 14 that defines a pressurized gas-filled chamber or region 16 and an illuminating member or light means 18. The balloon 10 provides an even greater degree of enjoyment than a conventional balloon in that it provides a steady or flashing light, inside of the gas-filled region 16 to illuminate the balloon membrane 12.

The present illuminated balloon 10 provides a number of advantages over known illuminated balloons. One significant advantage is that the light means 18 is completely contained within the balloon 10 and thus, a separate battery "compartment" is not required. Because a separate battery compartment is not needed, there are no electrical wires or electrical connectors that extend between the light and the power source that are outside of or external to the balloon 10, that could otherwise become tangled or tear.

Moreover, unlike known illuminated balloon devices, the present illuminated balloon 10 uses a light means 18 that is sufficiently light-weight that it does not adversely impact the ability of the balloon 10 to "float" in air when it is filled with a buoyant gas, such as helium.

The balloon membrane 12 is formed of a substantially gas-impermeable, pressurizable material. In one known form, the membrane 12 is formed from a film-like polymeric material, such as polyethylene terephthalate (commonly referred to as PET). PET can be formed as a fabric, a film and the like. One known film-formed material is sold under the name Mylar®. This material has various characteristics that make it well suited for use in the present invention. First, it can be formed in a variety of tints, shades and colors. It can also be produced having an opaque appearance as well as in transparent form.

Advantageously, the material can be made such that while it is relatively gas-impermeable and sufficiently flexible to take a particular form when it is inflated or filled, it is also relatively unexpandable. That is, although the material takes on a particular shape when it is filled, it does not, like rubber or latex materials, stretch to any great extent. Thus, the film-type materials are well suited for creating various shapes, sizes and designs for such balloons, which maintain their shape when inflated.

In forming such balloons 10, typically, two pieces of the film material, in the present case, two balloon panels 20, 22, are cut or otherwise produced into a particular shape, such as the commonly recognizable round shape. The panels 20, 22 are then sealed to one another at their respective peripheral edges 24, 26.

A neck 28 is formed in the balloon 10 which terminates in a filling nozzle 30. The neck area 28 and filling nozzle 30 remain unsealed when the balloon 10 is fabricated, and provide a passage for introducing gas into the pressure region 16. A valve (not shown) can be positioned in the neck at about the nozzle 30 for introducing gas into the pressure region 16. Alternately, a sealing member (not shown) can be formed in the balloon 10 to seal the balloon 10 to maintain the gas in the pressure region 16. Those skilled in the art will recognize that there are various methods and devices for sealing such balloons 10. A ribbon 32, string or the like can be tied around the neck area 28 to provide a handle for the balloon 10. In a typical arrangement, the balloon 10 will be filled with a buoyant gas, such as helium, which has a lesser density than air, so that the balloon 10 "floats" in air.

Figure 9:
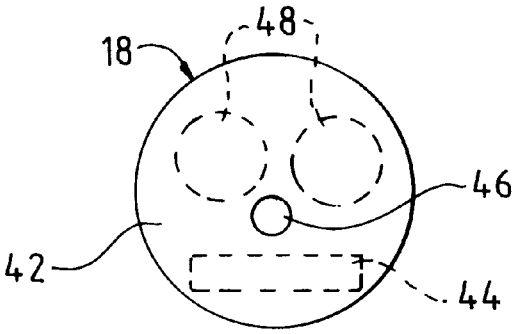
FIG. 9 is an illustration of an exemplary light button used with the illuminated balloon of the present invention.
Figure 10:
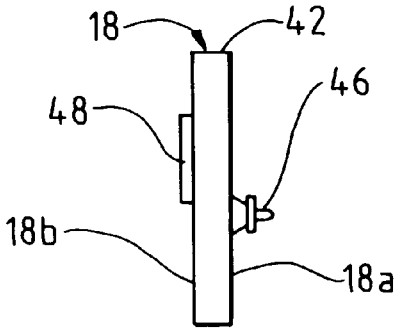
FIG. 10 is an illustration of the light button of FIG. 9 viewed from the side thereof.

The illuminated balloon 10 illustrated in FIGS. 1–4 includes an illuminating member or light means 18 mounted interior of the balloon 10, completely within the pressure region 16. The illuminating member 18 can take the form of a light button, which is illustrated in FIGS. 9 and 10. The light button 18 is a self-contained unit including a printed circuit board 42 having appropriate circuitry 44 for providing power to an illuminating device 46, and a power supply 48.

In a current embodiment, the light button 18 includes a light emitting diode 46, commonly referred to as an LED, mounted to a printed circuit board 42. One or more batteries 48 are mounted to the board 42 to provide power to light the LED 46. The circuit board 42 can include circuitry 44 for providing pulsating power to illuminate the LED 46 to produce a flashing effect. An embodiment of one such light button 18 is disclosed in Lewis et al., U.S. Pat. No. 5,143,439, the disclosure of which is incorporated herein by reference. The light button 18 is commercially available from Buztronics, Inc., of Indianapolis, Ind.

As shown in FIGS. 9 and 10, the LED 46 can be mounted to the circuit board 42 so that the LED 46 extends outwardly from the face 18*a* of the board 42. The LED 46 has a relatively small diameter, particularly when compared to the diameter or size of the circuit board 42.

Figure 2:
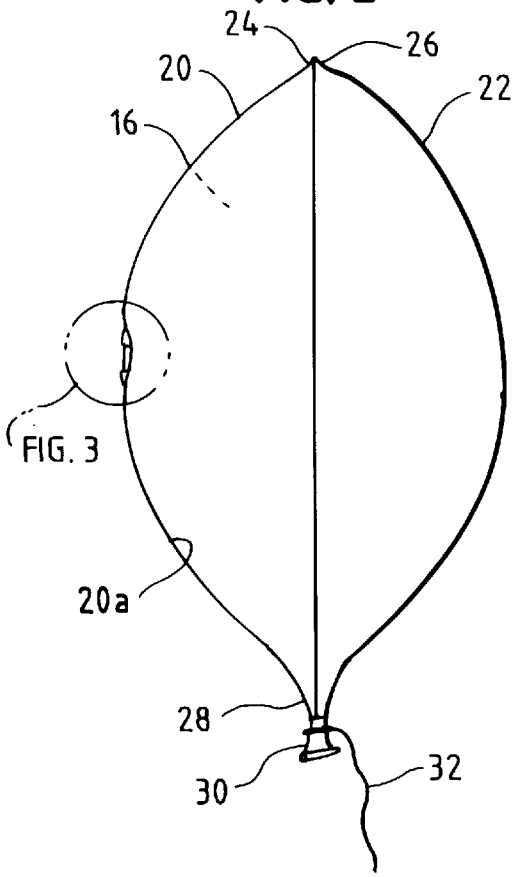
FIG. 2 is a side view of the balloon of FIG. 1, showing, in partial cross-section, the light button mounting.
Figure 3:
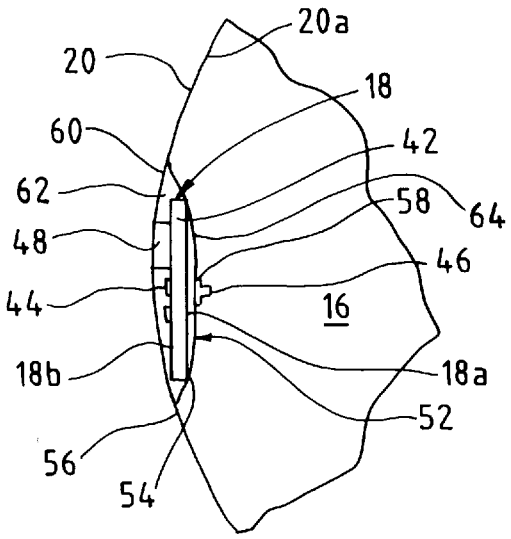
FIG. 3 is an enlarged view of the light button mounting as indicated by the circled area of FIG. 2.
Figure 4:
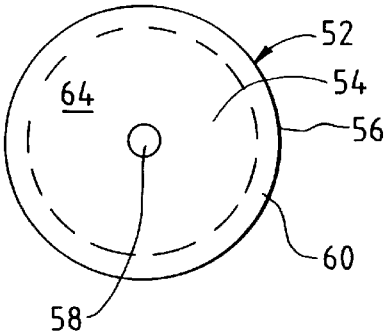
FIG. 4 is a front view of the mounting member used with the balloon of FIG. 1.

In a current balloon 10 configuration, as shown in FIGS. 2 and 3, the light button 18 is mounted to an interior surface 20*a* of the balloon panel 20. The button 18 is mounted to the panel 20 by a mounting member 52. The mounting member 52, a front view of which is shown in FIG. 4, includes a main body portion 54 defining a peripheral edge 56 and a central opening 58. The member 52 includes an adhesion region 60 that is adjacent to the peripheral edge 56 for adhering the member 52 to the panel surface 20*a*.

In assembling the balloon 10, the light button 18 is positioned on the inside surface 20*a*of the panel 20, with the LED 46 directed inwardly of the pressure region 16. The mounting member 52 is positioned over the front portion 18*a* of the light button 18 such that the LED 46 extends through the member opening 58. For purposes of the present disclosure, the front portion 18*a* of the light button 18 is that portion from which the LED 46 extends, and the rear portion 18*b* is that portion on which the batteries 48 are mounted. The mounting member 52 is then affixed to the panel 20, thus defining a light button pocket 62 in which the light button 18 is secured to the panel 20.

The mounting member 52 is adhered to the panel 20 at about the adhesion region 60. It will be readily apparent from the figures that the adhesion region 60 is at a location on the member 52 defining a diameter slightly greater than the diameter of the light button 18. In this configuration, the light button 18 is not subjected to any adhesive forces between the member 52 and the panel 20, but is maintained fixedly in place relative to the panel 20.

Those skilled in the art will recognize that there are various methods for adhering the mounting member 52 to the panel 20, and, likewise, various methods for sealing the peripheral edges 24, 26 of the balloon panels 20, 22 to one another. In a current embodiment of the balloon 10, the member 52 is mounted to the panel 20 and the panels 20, 22 to one another by a heat sealing or heat fusion process. Other methods are known in the art for joining or fusing such material, which other methods are within the scope of the present invention.

The present light button 18 mounting configuration is well suited for use with film-type balloons. Because the balloon panels 20, 22 are joined to one another after the "film" is formed, the light button 18 and mounting member 52 can be positioned on and adhered to the balloon panel 20 prior to joining the balloon panels 20, 22 together. Advantageously, this provides the ability to mount the button 18 in a wide range of positions on the panel 20. As such, varied and interesting balloon 10 designs can be created. Moreover, because of the relatively small amount of heat that is emitted from the light button 18 there is minimal concern regarding placement of the button 18 in the balloon 10. This also expands the creative possibilities of such balloon 10 designs.

Optionally, the mounting member 52 can be produced having a reflective facing material on that portion of the member, as indicated at 64, that is facing inwardly of the pressure region 16. It will be readily apparent from the drawings that such an arrangement facilitates producing a wide variety of visually pleasing effects. This is particularly so, although not necessary, when the reflective surface 64 is used in conjunction with a reflective rear panel 22. Such a combination of reflective surfaces 64, 22 permits the light from the LED 46 to repeatedly "bounce" off of the respective surfaces 64, 22 to further enhance the visual effects produced by the balloon 10.

Figure 5:
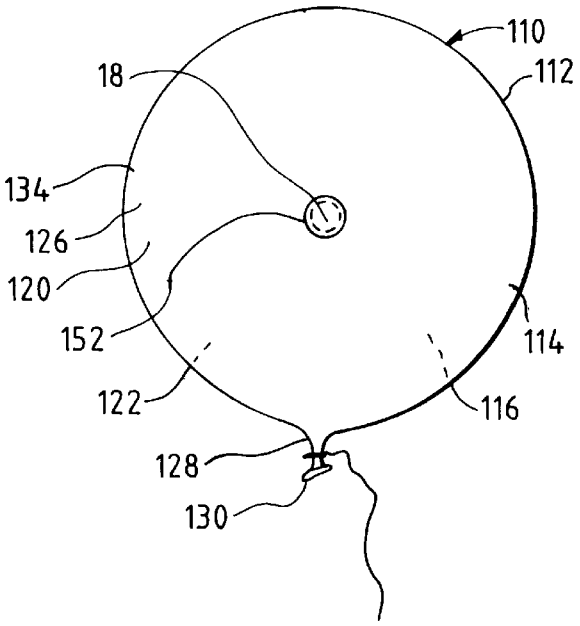
FIG. 5 is a front view of another embodiment of a film-type illuminated balloon having the light button positioned in an outside mount configuration.
Figure 6:
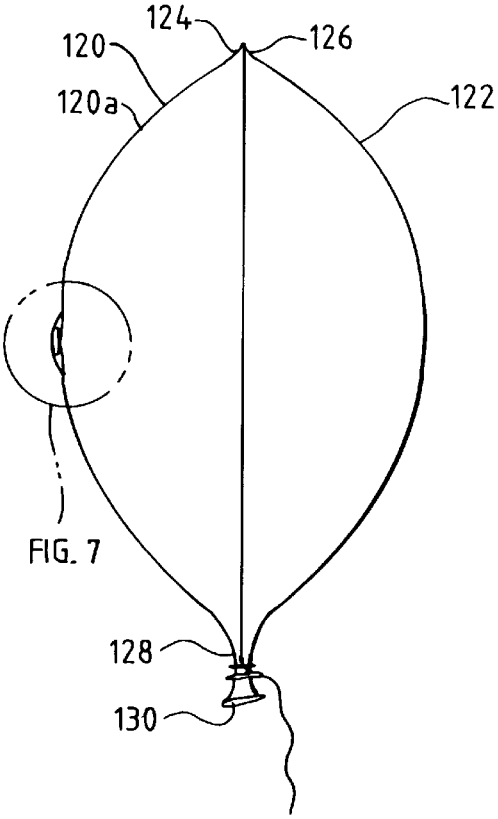
FIG. 6 is a side view of the balloon of FIG. 5, showing, in partial cross-section, the light button mounting.
Figure 7:
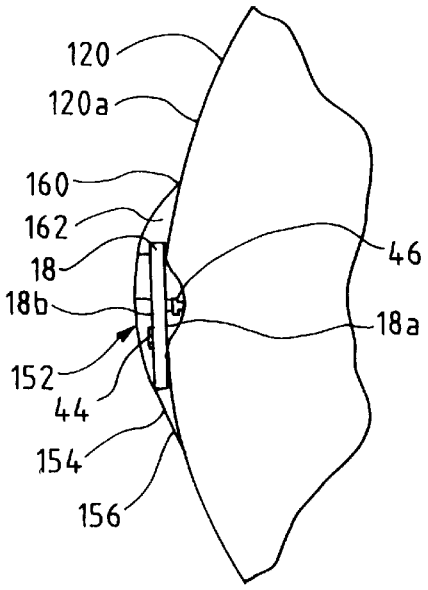
FIG. 7 is an enlarged view of the light button mounting as indicated by the circled area of FIG. 6.

An alternate embodiment 110 of the balloon is show in FIGS. 5–7, in which the light button 18 is mounted on an exterior or outside surface 120*a* of the balloon panel 120. For purposes of the present disclosure, this will be referred to as the outside mount. The light button 18 is mounted to the panel 120 by a mounting member 152 similar to the mounting member 52 shown in FIG. 7, except that the member 152 does not have an LED opening. Rather, because the mounting member 152 is positioned adjacent or over the rear portion 18*b* of the light button 18, away from the LED 46, the member 152 does require an opening for the LED 46 to extend through. Unlike the mounting member 52 illustrated in FIG. 4 which enhances the visual effects of the balloon 10, the outside mount mounting member 152 does not affect the light emitted from the LED 46.

Similar to the embodiment 10, this alternate embodiment of the balloon 110 includes a membrane 112 that defines a balloon body 114. The body 114 defines a pressure region 116. The body 114 is formed from first and second panels 120, 122, which are sealed to one another at their respective peripheral edges 124, 126. The body 114 further defines a neck area 128 that terminates at a filling nozzle 130. Also similar to the embodiment 10, in this embodiment, the mounting member 152 includes a main body portion 154.

In this embodiment 110, because the visual effects are neither detracted from, nor enhanced by the mounting member 152, the mounting member 152 can be made of any type of material. Moreover, because the mounting member 152 is exterior of the balloon pressure region 116, the material from which the member 152 is fabricated is not required to be gas impermeable or even a solid element. Rather, an open-type material can be used for the outside mount member 152.

Similar to the inside mount member 52, the outside mount member 152 has a peripheral edge 156 that defines an adhesion region 160. The member 152 is sufficiently larger than the light button 18 such that the adhesion region 160 extends beyond the edge of the light button 18. In this configuration, the light button 18 is not affected by adhering the mounting member 152 to the panel 120. When the mounting member 152 is affixed to the panel 120, it defines a light button pocket 162 in which the light button 18 is secured to the panel 120.

Advantageously, use of the present light button 18 permits the button 18 to be positioned with the LED 46 resting against the balloon panel 120, without adversely affecting the balloon 110. The relatively small amount of heat that is emitted from the LED 46 has minimal if any affect on the balloon panel 120, and has been shown to not impact the life expectancy of the balloon 110 nor significantly degrade the integrity of the balloon 110 material.

Figure 8:
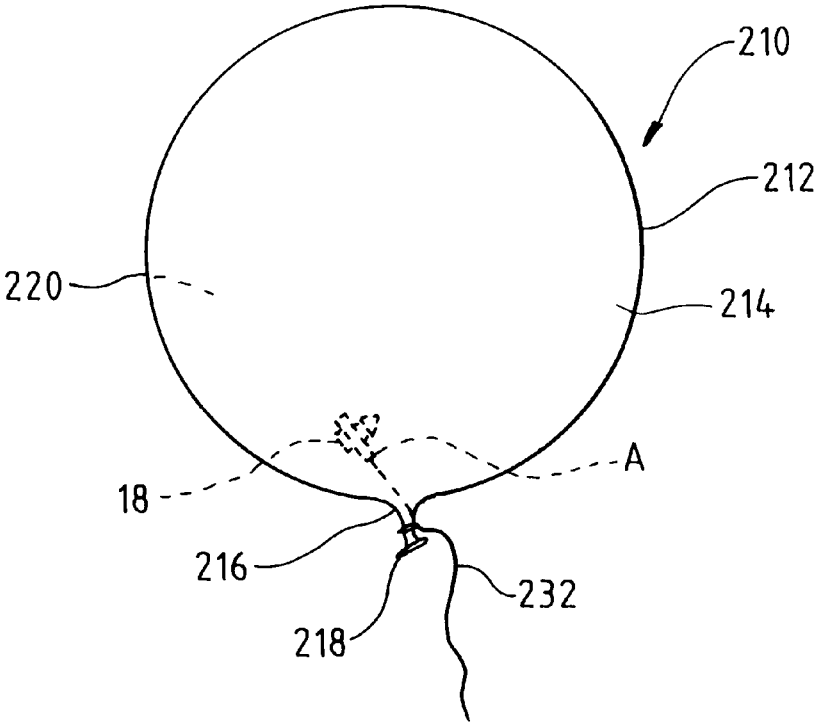
FIG. 8 is a front view of still another embodiment of the illuminated balloon, in accordance with the principles of the present invention, in which the balloon is of the latex-type, and which includes a light button freely placed in the balloon pressure region.

Still another embodiment 210 of the illuminated balloon is illustrated in FIG. 8. The embodiment 210 uses a common latex balloon membrane 212. The balloon 210 has a body portion 214, a neck 216 and a filling opening 218. In this embodiment 210, the light button 18 is positioned inside of the balloon body 214, through the filling opening 218 and neck 216. The balloon 210 is then inflated with, for example, helium, and the neck 216 is sealed, with the light button 18 inside of the balloon 210. Rather than positioning the light button 18 on the membrane 212 at a specific location, the light button 18 is permitted to freely move about the pressure region 220 of the balloon 210.

Optionally, as shown in FIG. 8, the light button 18 can be attached to the ribbon 232 by, for example, a small amount of an adhesive A, such as a hot melt glue. Essentially, the ribbon 232 serves as a tethering member for the button 18. In this arrangement, with the light button 18 secured to the ribbon 232, in the event that the balloon 210 burst, the light button 18 is tethered by the ribbon 232 and will remain secured thereto. In this embodiment of the balloon 210, when the balloon neck 216 is knotted to seal the balloon 210, the ribbon 232 is knotted with the neck 216.

As discussed previously, because the amount of heat that is generated by the light button 18 and LED 46 is relatively small, unlike known illuminated balloon devices, it is not necessary to particularly position the light button 18 therein. Rather, because the amount of heat generated is minimal, the light button 18 can be left to "bounce around" within the balloon 210 to create striking and interesting visual effects. These visual effects are particularly highlighted when the balloon 210 is bounced or jostled, which in turn bounces the light button 18 from a resting position within the balloon pressure region 220. The balloon membrane 212 can be formed of colored, transparent or translucent material, or any combination of materials to further create different, visually pleasing effects.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An illuminated balloon comprising:

a substantially gas-impermeable membrane formed of a film-like material capable of pressurized gas storage, said membrane defining a gas storage region, said balloon having an inner surface and an outer surface and defining a neck portion having an opening therein for introducing a gas to inflate the balloon; and a light means, said light means being self-contained and including an illuminating element and a power source electrically connected thereto, said light means including said power source being completely within said gas storage region; and a mounting member for mounting said light means to said balloon inner surface on said membrane, wherein said mounting member includes a peripheral edge and defines an opening therein spaced from said peripheral edge, said opening being in said mounting member and aligning with said illuminating element when said mounting member is positioned on said membrane with said light means disposed therebetween.

2. The illuminated balloon in accordance with claim 1 wherein said mounting member includes an adhesion region at about said peripheral edge, and wherein said mounting member is affixed to said membrane at said adhesion region.

3. An illuminated balloon comprising:

a substantially gas-impermeable membrane capable of pressurized gas storage, said membrane defining a gas storage region, said balloon having an inner surface and an outer surface and defining a neck portion having an opening therein for introducing a gas to inflate the balloon; and a light means, said light means being self-contained and including an illuminating element and a power source electrically connected thereto, said light means including said power source being completely within said gas storage region, including a tethering member affixed to the light means, said tethering member extending through said opening in said neck portion when said light means is positioned within said gas storage region.

4. The illuminated balloon in accordance with claim 3 wherein said membrane is formed of an expandable material.

5. The illuminated balloon in accordance with claim 4 wherein said membrane is formed of latex rubber.

6. The illuminated balloon in accordance with claim 3 wherein said tethering member extends from said neck portion to form a handle for said balloon.

7. An illuminated balloon comprising:

a substantially gas-impermeable film-like membrane capable of pressurized gas storage, said membrane defining a gas storage region and being formed by at least first and second panels, said membrane having an inner surface and an outer surface, said membrane further having a neck portion with an opening therein for introducing a gas to inflate the balloon; and a light emitting member, said member being self-contained and including an illuminating element and a power source electrically connected thereto, said light emitting member including said power source being completely within said gas storage region; and a mounting member configured to be affixed to one of said panels, wherein said light emitting member is positionable between said mounting member and said panel.

8. The illuminated balloon in accordance with claim 7 wherein said mounting member is positioned on an inside surface of said panel within said gas storage region.

9. The illuminated balloon in accordance with claim 8 wherein said mounting member defines a peripheral edge and an opening spaced from said peripheral edge, and wherein said opening is configured and positioned in said mounting member to receive said illuminating element when said mounting member is positioned on said panel with said light emitting member positioned therebetween.

10. The illuminated balloon in accordance with claim 9 wherein said mounting member has a reflective surface.

11. The illuminated balloon in accordance with claim 7 wherein said mounting member is affixed to an outside surface of said panel and wherein said light emitting member is positioned between said mounting member and said panel when said mounting member is positioned on said panel.

12. The illuminated balloon in accordance with claim 11 wherein at least one of said panels is transparent and wherein said light emitting member is positioned on said transparent panel.

13. The illuminated balloon in accordance with claim 12 wherein another of said panels has a reflective surface.

* * * * *